US007967613B2

(12) United States Patent
Zheng

(10) Patent No.: US 7,967,613 B2
(45) Date of Patent: Jun. 28, 2011

(54) POWER UNIT FOR LED DISPLAY

(75) Inventor: Zhongliang Zheng, Hangzhou (CN)

(73) Assignee: Thinksign Optoelectronics, Inc., Binjiang High-Tech Zone, Hangzhou, Zhejiang Province (CN)

( * ) Notice: Subject to any disclaimer, the term of this patent is extended or adjusted under 35 U.S.C. 154(b) by 96 days.

(21) Appl. No.: 12/615,227

(22) Filed: Nov. 9, 2009

(65) Prior Publication Data

US 2011/0111636 A1 May 12, 2011

(51) Int. Cl.
*H01R 12/16* (2006.01)

(52) U.S. Cl. ..... 439/76.1

(58) Field of Classification Search ..... 439/76.1, 439/682, 350, 74, 78, 638, 883; 174/59; 361/730, 736, 748, 752, 686
See application file for complete search history.

(56) References Cited

U.S. PATENT DOCUMENTS 4,842,528 A * 6/1989 Frantz ..... 439/80
6,129,598 A * 10/2000 Yu et al. ..... 439/883
6,786,758 B2 * 9/2004 Chen et al. ..... 439/449
7,187,544 B2 * 3/2007 Tsai ..... 307/43
7,328,046 B2 * 2/2008 Koskelainen et al. ..... 455/561
7,491,095 B1 * 2/2009 Huang ..... 439/682
2007/0128945 A1 * 6/2007 Huang ..... 439/638
2007/0218715 A1 * 9/2007 Itou et al. ..... 439/74
2008/0076277 A1 * 3/2008 Chen et al. ..... 439/78
2008/0166900 A1 * 7/2008 Chang ..... 439/76.1
2008/0274631 A1 * 11/2008 Lee et al. ..... 439/78
2008/0293292 A1 * 11/2008 Wu et al. ..... 439/494
2010/0157749 A1 * 6/2010 Ogawa et al. ..... 369/44.11

* cited by examiner

*Primary Examiner* — Alexander Gilman

(57) ABSTRACT

A power unit for LED display includes a main power unit body comprising a plurality of power terminals and a plurality of clapboards provided between each two power terminals respectively, a socket plate comprising a socket having a plurality of plugholes and a plurality of spacedly apart connectors extending from the socket for being inserted into the plurality of clapboards for connecting with the plurality of power terminals respectively, and a plug adapted for connecting to the socket plate, comprising a plurality of plug heads corresponding with the plurality of plugholes for being inserted into the plurality of plugholes respectively.

9 Claims, 4 Drawing Sheets

POWER UNIT FOR LED DISPLAY

BACKGROUND OF THE PRESENT INVENTION

1. Field of Invention

The present invention relates to a power unit for LED display, and more particularly to a plug-in type power unit for LED display, wherein the power unit connects with power consumption devices of LED display via plugs.

2. Description of Related Arts

LED displays are widely used in various situations, such as stadiums, malls, airports, casinos, and stages. The power unit supplies power to the power consumption devices in the LED display to enable the LED display to work, so the power unit is a key element in the LED device. The connection manner of the power unit and power consumption devices in the LED display affects the mounting efficiency of the LED display. As shown in FIG. 1, the power wires are connected to the power terminals respectively. To mount the LED display, the power wires have to be connected to the power terminals one by one by using screwdriver; to dismount the LED display, the power wires have to be disconnected with the power terminals one by one by using screwdriver again, which is very troublesome and inconvenient, and needs to be improved.

SUMMARY OF THE PRESENT INVENTION

An object of the present invention is to provide a plug-in type power unit for LED display, which can conveniently provide power to power consumption devices in the LED display.

Accordingly, in order to accomplish the above object, the present invention provides a power unit for LED display including:

a main power unit body, comprising a plurality of power terminals provided on one side of the main power unit body for leading electricity out, a socket plate connected with the plurality of power terminals and comprising a socket having a plurality of plugholes, and a plug, comprising a plurality of plug heads corresponding with a plurality of plugholes respectively for being inserted into the plurality of plugholes.

These and other objectives, features, and advantages of the present invention will become apparent from the following detailed description, the accompanying drawings, and the appended claims.

DETAILED DESCRIPTION OF THE PREFERRED EMBODIMENT

Figure 1:
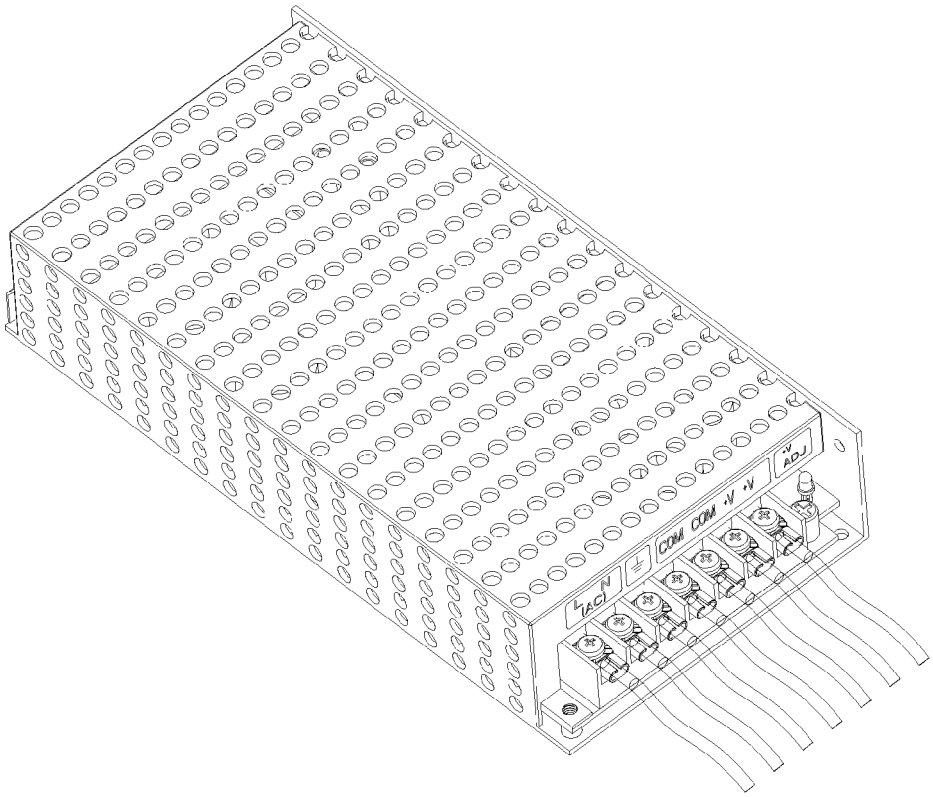
Fig. 1 (Prior Art)
FIG. 1 is a perspective view of a conventional power unit for LED display.
Figure 2:
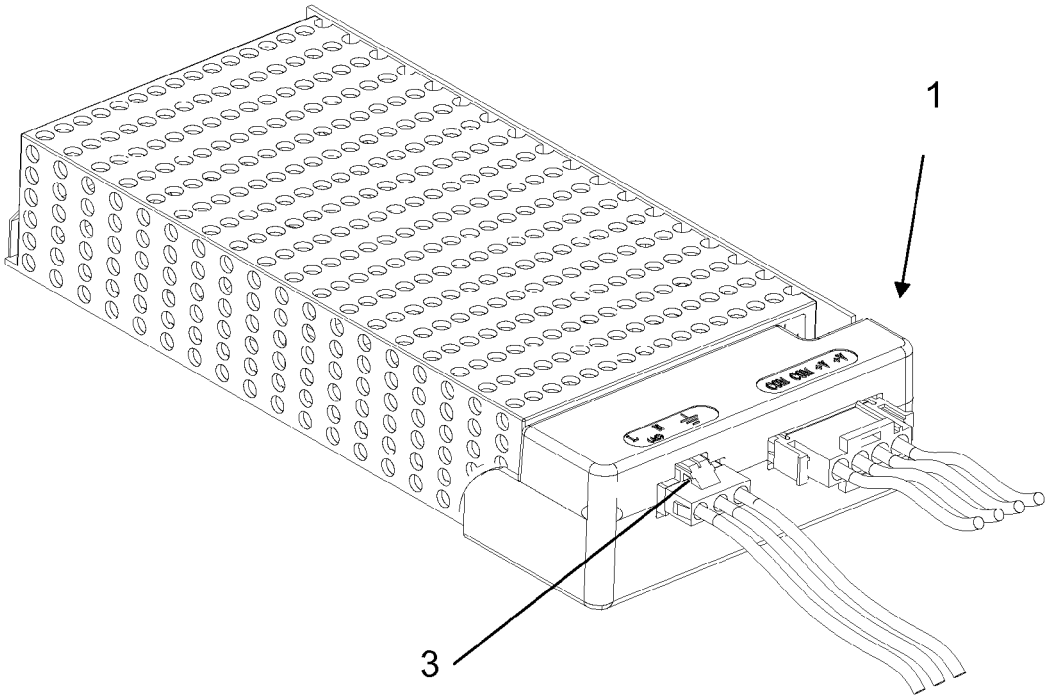
FIG. 2 is a perspective view of a power unit for LED display according to a preferred embodiment of the present invention.

Referring to FIG. 2 through FIG. 5 of the drawings, a power unit for LED display according to a preferred embodiment of the present invention is illustrated, in which the power unit for LED display comprises a main power unit body 1 comprising a plurality of power terminals 11, a socket plate 2 connected with the plurality of power terminals 11, and a plug 3 adapted for connecting to the socket plate 2, wherein the plug 3 connects with the power consumption devices, so that the power unit can supply power to the power consumption devices in LED display.

The plurality of power terminals 11 are provided on one side of the main power unit body 1 to lead electricity out. The socket plate 2 is connected with the plurality of power terminals 11, and comprises a socket 21 having a plurality of plugholes. The plug 3 comprises a plurality of plug heads 31 corresponding with the plurality of plugholes 211 for being inserted into the plurality of plugholes 211 respectively. Therefore, the plug 3 can electrically connected with the power unit so as to supply power to the power consumption devices in the LED display.

Figure 3:
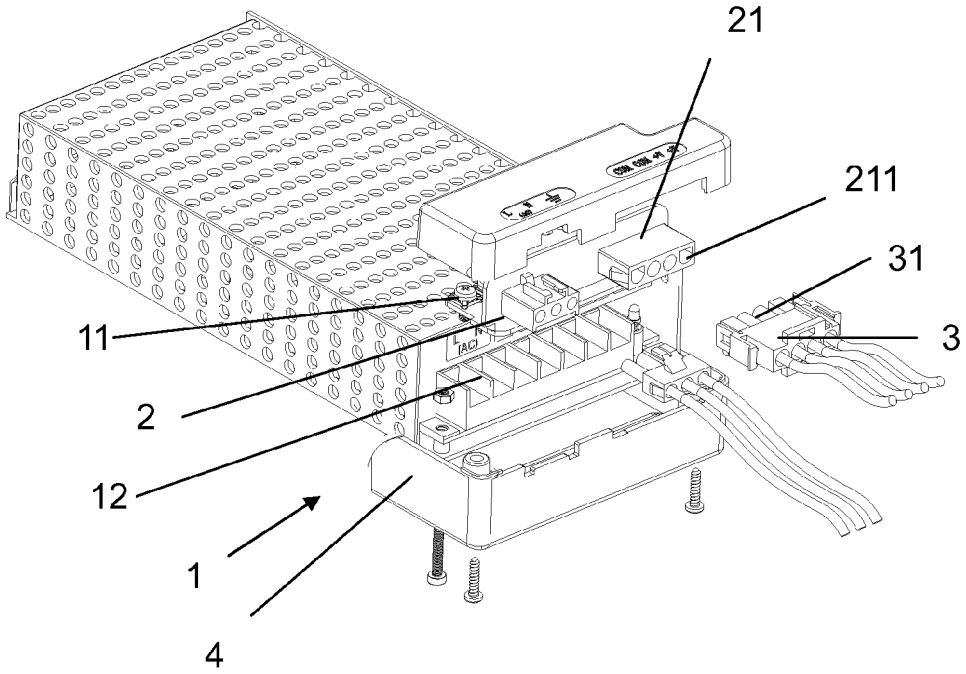
FIG. 3 is an exploded view of a power unit for LED display according to the above preferred embodiment of the present invention.
Figure 4:
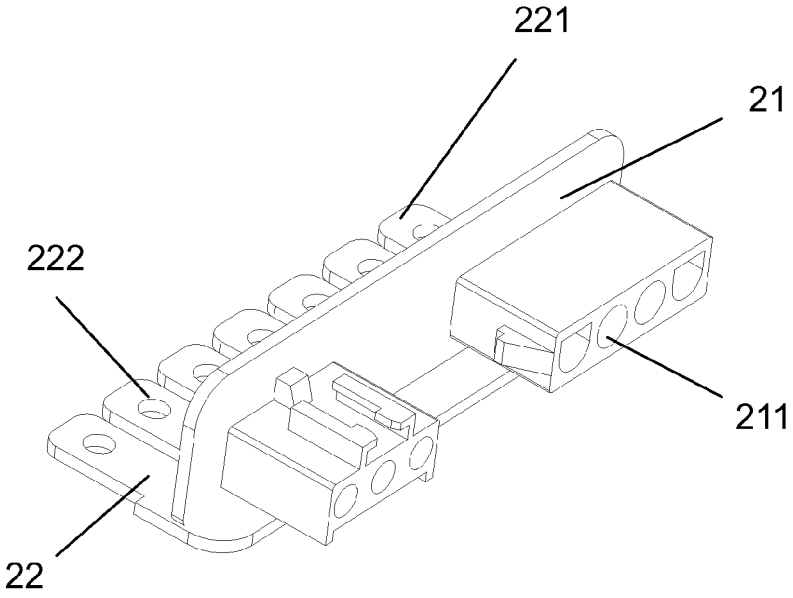
FIG. 4 is a perspective view of a socket plate according to the above preferred embodiment of the present invention, wherein the plate and socket are securely connected.
Figure 5:
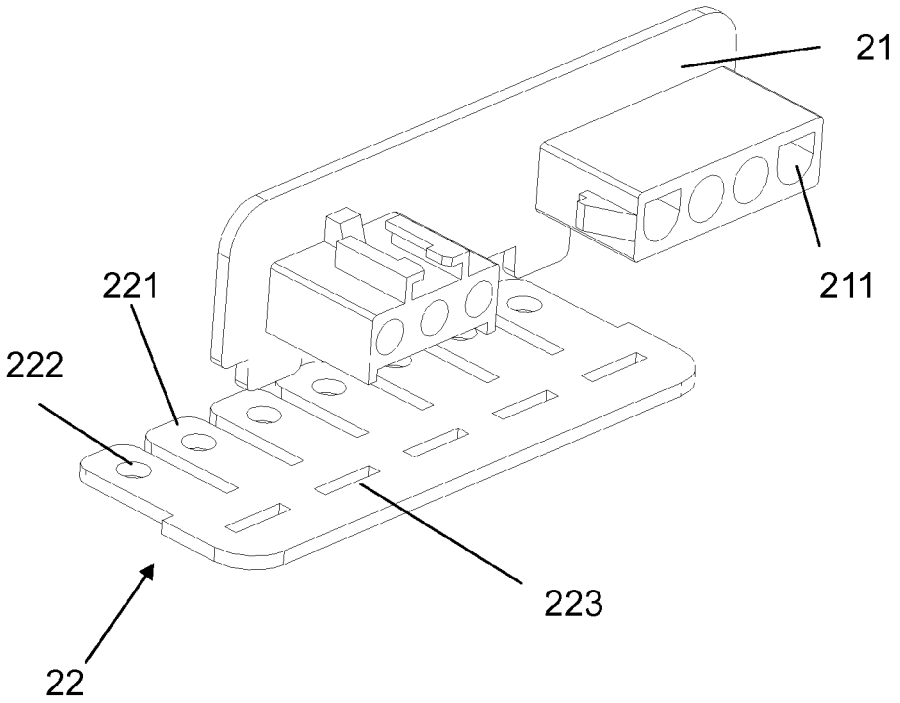
FIG. 5 is a perspective view of a socket plate according to the above preferred embodiment of the present invention, wherein the plate and socket are separated.

Please refer to FIG. 3, a plurality of upright clapboards 12 are provided between each two power terminals 11 respectively. Further refer to FIG. 4 and FIG. 5, the socket plate 2 comprises a plate 22, comprising a plurality of spacedly apart connectors 221 extending forward for inserting into the plurality of clapboards 12 so as to connecting with the plurality of power terminals 11 respectively. Each connector 221 has a through hole 222 at a front end thereof; a screw can pass through the hole to secure the connection of power terminal 11 and connector 221. The plate 22 has a plurality of spacedly apart grooves 223 at an opposed side of the connector 221. The socket 21 of the socket plate 2 comprises a plurality of spacedly apart feet 212 extending downwardly for inserting into the grooves 223 of the plate 22, so that the plate 22 are secured with the socket 21. The socket 21 has a plurality of plugholes 211 facing outside for receiving the plug heads 31 of the plug 3.

In this preferred embodiment, the socket plate 2 may comprises a plurality of sockets 21, each having a plurality of plugholes 211, for receiving a plurality of plugs 3 respectively so as to connect different power consumption devices.

The power unit for LED display of the present invention further comprises a housing 4 for covering the main power body 1 and socket plate 2 without covering the plugholes 211.

Figure 6:
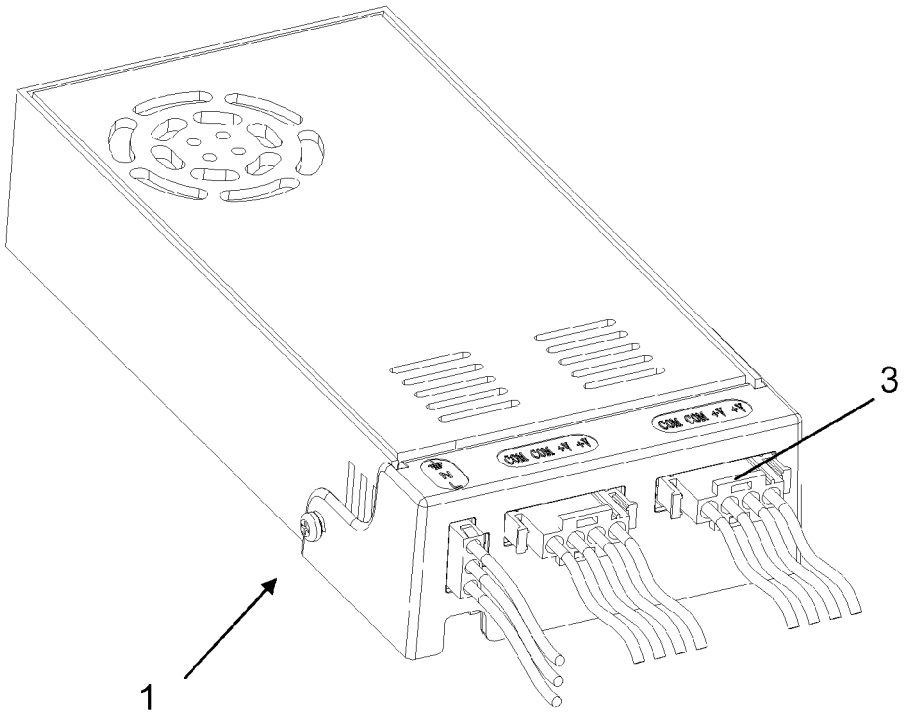
FIG. 6 is a perspective view of a power unit for LED display according to another preferred embodiment of the present invention.
Figure 7:
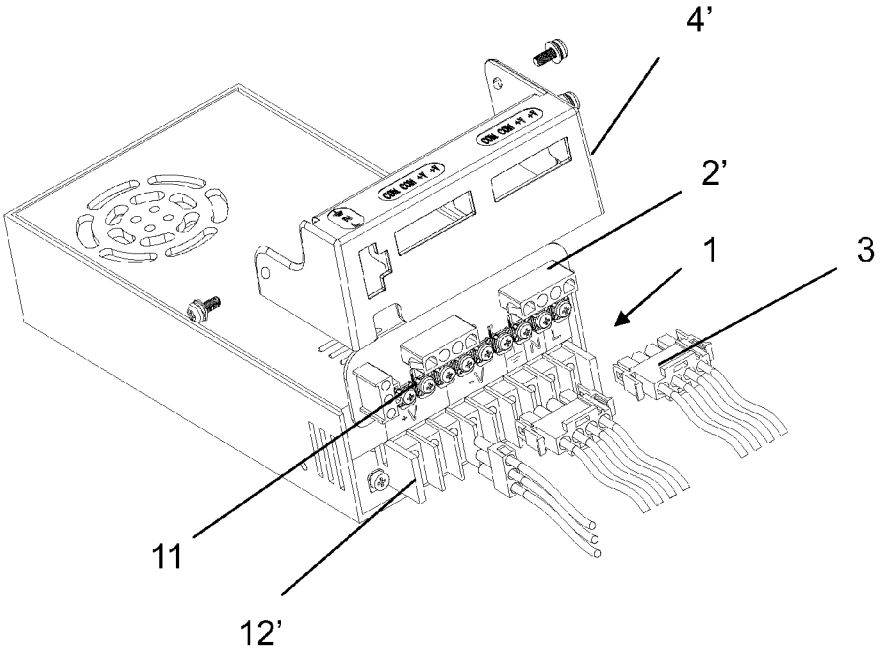
FIG. 7 is an exploded view of a power unit for LED display according to the above preferred embodiment of the present invention.
Figure 8:
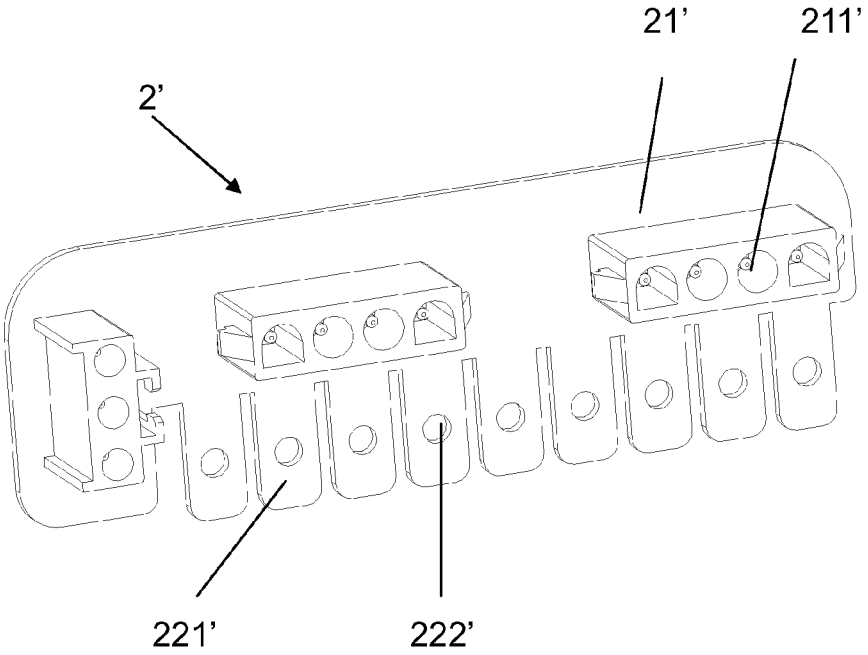
FIG. 8 is a perspective view of a socket plate according to the above preferred embodiment of the present invention.

FIG. 6 through FIG. 8 shows another preferred embodiment of the present invention. A plurality of clapboards 12' are provided between each two power terminals 11 respectively. The socket plate 2' comprises a plurality of spacedly apart connectors 221' extending downwardly for inserting into the plurality of clapboards 12' so as to connecting with the plurality of power terminals 11 respectively. Each connector 221' has a through hole 222' at a front end thereof; a screw can pass through the hole to secure the connection of power terminal 11 and connector 221'. The socket 21' has a plurality of plugholes 211' facing outside for receiving the plug heads 31 of the plug 3.

In this preferred embodiment, the socket plate 2' may comprises a plurality of sockets 21', each having a plurality of plugholes 211', for receiving a plurality of plugs 3 respectively so as to connect different power consumption devices.

The power unit for LED display of the present invention further comprises a housing 4' for covering the main power body 1' and socket plate 2' without covering the plugholes 211'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A power unit for LED display, comprising:

a main power unit body comprising a plurality of power terminals and a plurality of clapboards provided between each two power terminals respectively, a socket plate comprising a socket having a plurality of plugholes and a plurality of spacedly apart connectors extending from the socket for being inserted into the plurality of clapboards for connecting with the plurality of power terminals respectively, and a plug adapted for connecting to the socket plate, comprising a plurality of plug heads corresponding with the plurality of plugholes for being inserted into the plurality of plugholes respectively.

2. The power unit for LED display, as recited in claim 1, wherein each connector has a through hole at a front end thereof for a screw to pass through as to secure connection of the power terminal and the connector.

3. The power unit for LED display, as recited in claim 1, wherein the socket plate further comprises a plate, wherein the plurality of spacedly apart connectors extending from the plate, and the plate has a plurality of spacedly apart grooves at an opposed end of the connector; the socket comprises a plurality of spacedly apart feet extending outwardly for inserting into the grooves of the plate, so that the plate are secured with the socket.

4. The power unit for LED display, as recited in claim 2, wherein the socket plate further comprises a plate, wherein the plurality of spacedly apart connectors extending from the plate, and the plate has a plurality of spacedly apart grooves at an opposed end of the connector; the socket comprises a plurality of spacedly apart feet extending outwardly for inserting into the grooves of the plate, so that the plate are secured with the socket.

5. The power unit for LED display, as recited in claim 1, wherein the socket plate comprises a plurality of sockets for receiving a plurality of plugs respectively.

6. The power unit for LED display, as recited in claim 4, wherein the socket plate comprises a plurality of sockets for receiving a plurality of plugs respectively.

7. The power unit for LED display, as recited in claim 1, further comprising a housing for covering the main power body and socket plate without covering the plugholes.

8. The power unit for LED display, as recited in claim 5, further comprising a housing for covering the main power body and socket plate without covering the plugholes.

9. The power unit for LED display, as recited in claim 6, further comprising a housing for covering the main power body and socket plate without covering the plugholes.

* * * * *